US012239173B2

(12) United States Patent
Wood

(10) Patent No.: US 12,239,173 B2
(45) **Date of Patent: *Mar. 4, 2025**

(54) JSW REFILLABLE DUST MASK

(71) Applicant: Jeffrey James Wood, Eastpointe, MI (US)

(72) Inventor: Jeffrey James Wood, Eastpointe, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/328,935

(22) Filed: Jun. 5, 2023

(65) Prior Publication Data

US 2023/0301375 A1 Sep. 28, 2023

Related U.S. Application Data

(63) Continuation of application No. 17/235,423, filed on Apr. 20, 2021, now Pat. No. 11,707,096.

(51) Int. Cl.
*A41D 13/00* (2006.01)
*A41D 13/11* (2006.01)

(52) U.S. Cl.
CPC ..... *A41D 13/1138* (2013.01)

(58) Field of Classification Search
CPC ..... A41D 13/1138; A41D 13/11; A41D 13/1107; A41D 13/113; A41D 13/1146; A41D 13/1161; A41D 13/1176
See application file for complete search history.

(56) References Cited

U.S. PATENT DOCUMENTS 1,502,450 A * 7/1924 Wood ..... A41D 13/1146 128/206.16
2,845,926 A * 8/1958 Hill ..... A62B 23/025 128/206.17

* cited by examiner

*Primary Examiner* — Steven O Douglas
(74) *Attorney, Agent, or Firm* — Lambert Shortell & Connaughton; David J. Connaughton, Jr.; Justin P. Tinger

(57) ABSTRACT

An invention to house a disposable dust mask or N95 mask in an independent comfortable and reusable face mask frame.

13 Claims, 5 Drawing Sheets

JSW REFILLABLE DUST MASK

CROSS REFERENCE TO RELATED APPLICATION

62/704,086

STATEMENT OF FEDERALLY SPONSORED RESEARCH OR DEVELOPMENT not applicable.

THE NAMES OF THE PARTIES OF A JOINT RESEARCH PROJECT not applicable.

REFERENCE TO A SEQUENCE LISTING not applicable.

BACKGROUND OF THE INVENTION

The JSW Refillable Dust Mask was designed to make it more comfortable and easier for construction workers, nurses and any other industries that need to wear N95 and other disposable dust masks all day long.

The disposable dust masks on the market usually have non adjustable light weight adjustable straps. These straps are usually very tight and uncomfortable. A person who owns a JSW mask will be able to take an N95 mask or any other disposable dust mask cut the elastic bands on them and slide them into the JSW frame. This will allow the person a much better and more comfortable seal around there face and better adjustment to the back of there head. The frame itself will be easily cleanable and easy to store.

BRIEF SUMMARY OF THE INVENTION

The JSW Refillable Dust Mask is a personnel protection face mask frame that is comfortable and easily cleanable. The mask frame is designed to receive disposable paper and cloth face masks such as N95 or any other dust mask on the market today.

A user will utilize the JSW mask frame by fitting and adjusting it to there face with the use of adjustable straps. The user will then take a disposable dust mask and fit it snugly in the front of the frame, if needed they can remove the straps from the disposable dust mask with scissors to allow an easy fit.

The mask will be fabricated with molded forms made of rubber or plastic or like materials. The mask will have elastic or plastic straps at the top and bottom of the frame.

DETAILED DESCRIPTION OF THE INVENTION

As shown in FIGS. 1-8, the JSW REFILLABLE DUST MASK is a dust mask frame designed to house many of the disposable dust mask on the market today. The first piece of the whole embodiment is the face piece. The face piece is a molded plastic, rubber or like material, flexible circular frame.

The face piece frame will have an outside diameter of 5½" with a thickness of ⅜". The top plate will be flat on the bottom side with a U shape to the top as shown in drawing (102 FIG. 2).

Figure 1:
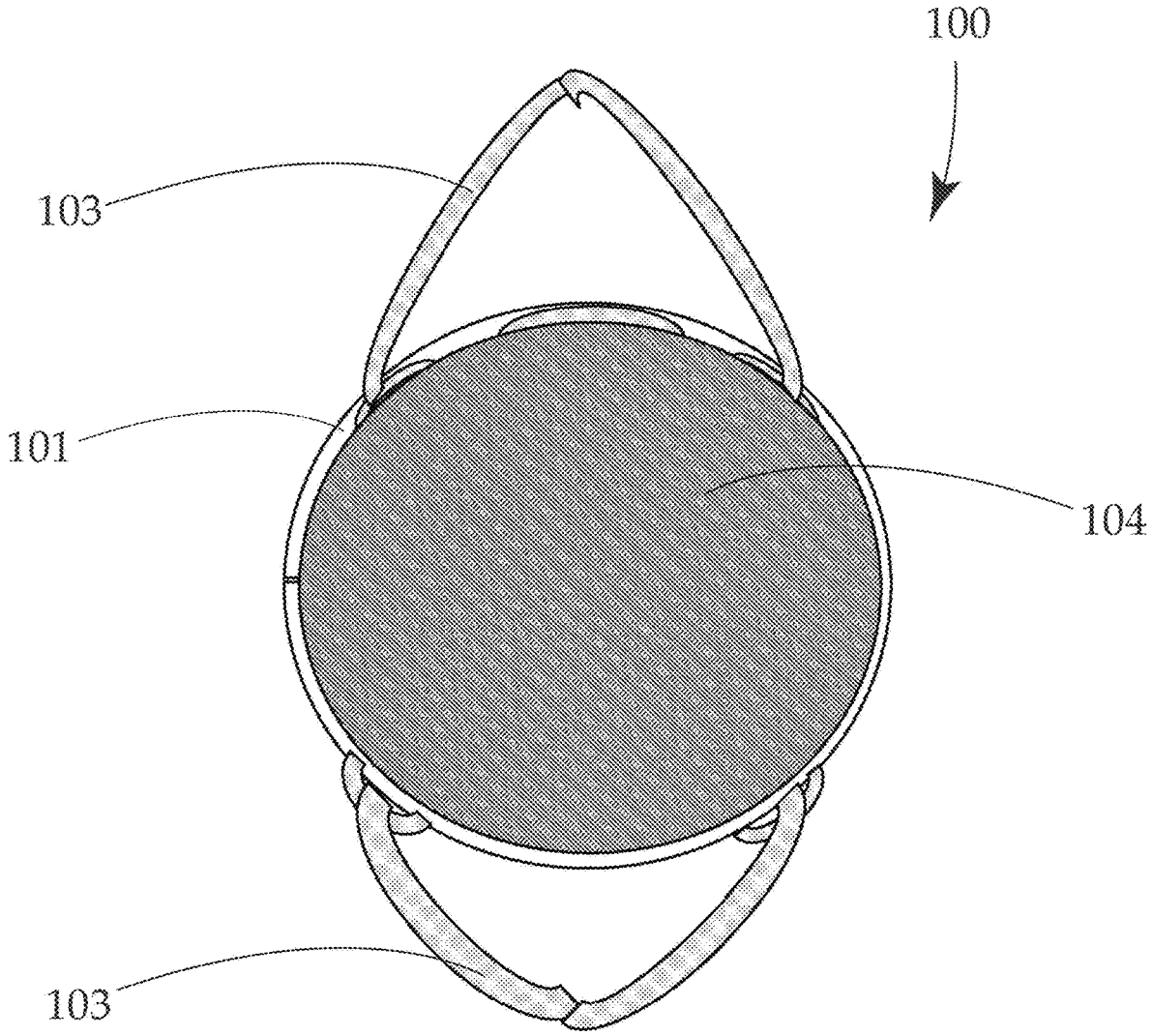
FIG. 1: shows a front view of the whole embodiment of the JSW-plastic frame with the disposable mask inserted.
Figure 2:
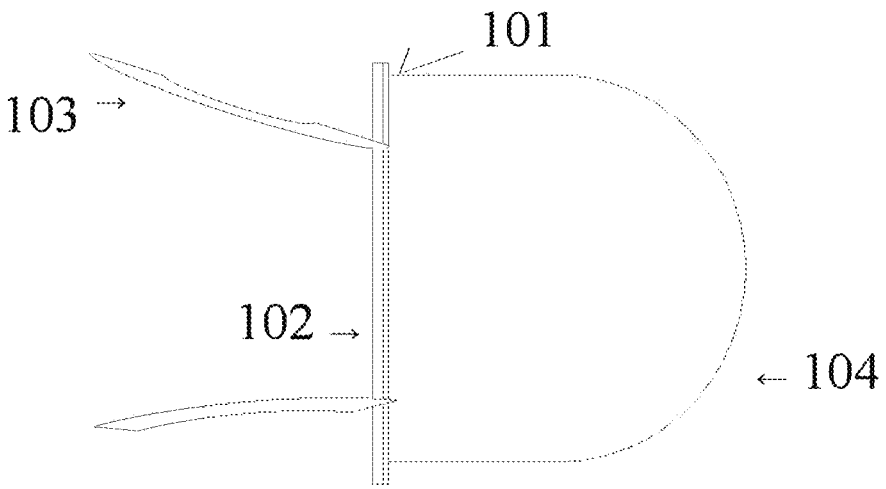
FIG. 2: shows the side view of the whole embodiment of the JSW plastic frame with the disposable mask inserted.
Figure 3:
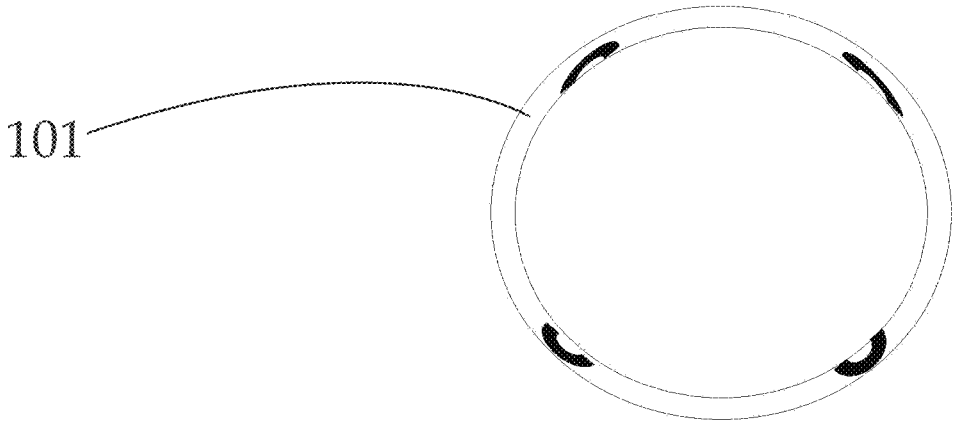
FIG. 3: shows the front view of the top piece of the plastic frame, (Part 101).
Figure 4:
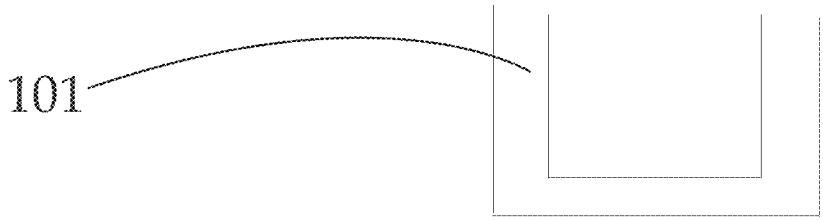
FIG. 4: shows the side cut view of top piece of the plastic frame.
Figure 5:
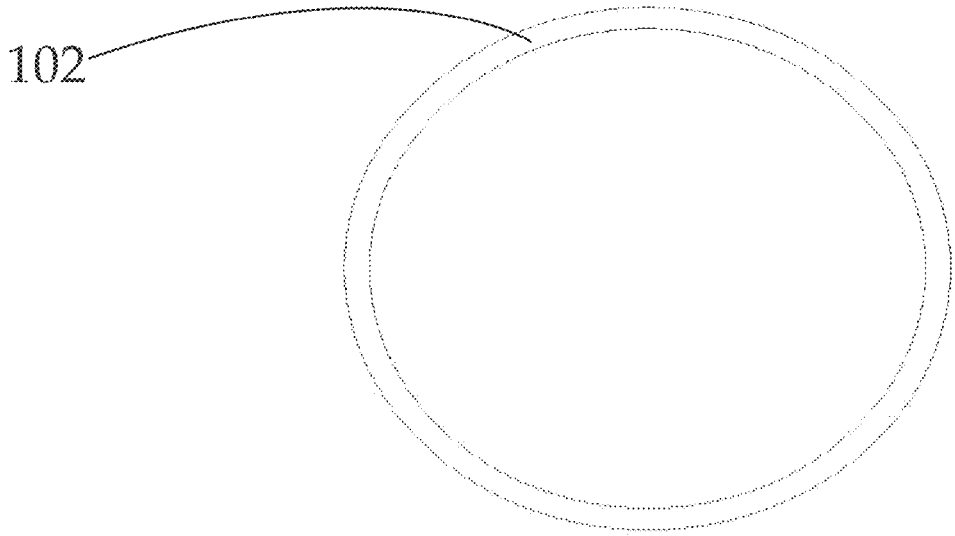
FIG. 5: shows the front view of the face piece of the plastic frame.
Figure 6:
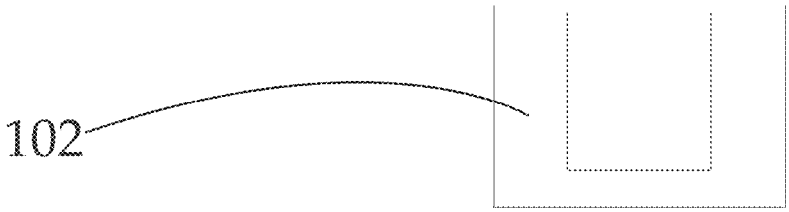
FIG. 6: shows the side cut view of the face piece of the plastic frame.
Figure 7:
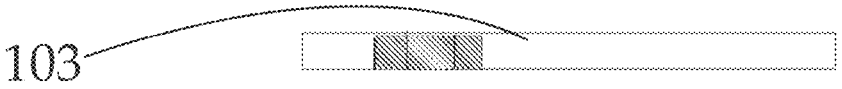
FIG. 7: shows the top view of the adjustable.
Figure 8:
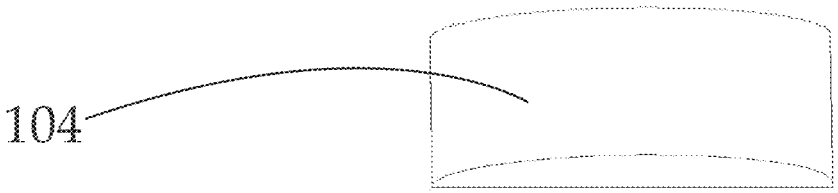
FIG. 8: shows a disposable dust mask.

The U shape face piece walls and bottom will have a thickness of 1/16" with a height of 3/16" of an inch as shown in drawing (102 FIG. 2).

The next part of the embodiment, the top plate will be made of the same material as the face plate. The top plate will be a circular frame with an outside diameter of 5⅜" with a thickness of ⅜". The top plate will be flat on the bottom with a U shape to the top as shown in drawing (101 FIG. 2). The U shaped top piece walls and bottom will have a thickness of 1/16" with a height of 3/16". The top piece will have hooks molded to the top and bottom of the frame 1½" down and up as shown in drawing (101 FIG. 1). The hooks will have a ½" opening to accept the adjustable straps.

The next piece of the embodiment will be the adjustable straps. Two straps ½" wide by 16" long one for the top and one for the bottom.

The next part of the embodiment will be a cone shaped disposable dust mask or N95 dust mask, as shown in (104).

To assemble the whole embodiment the face piece should be on a flat surface then insert the disposable dust mask inside the U shaped walls. The next step would be to take the top plate and snap it in over top of the removable mask and inside the U of the top piece. The next step would be to install the elastic straps to the top and bottom of the top plate and adjust to the person's face accordingly.

What is claimed is:

1. A face mask apparatus comprising:

a bottom face piece having a ring shaped body, the ring shaped body defining a U-shaped top surface;

a top plate having a ring shape, the top plate defining a U-shaped bottom surface, the top plate having an outer diameter slightly larger than an outer diameter of the bottom face piece such that an inner part of the U-shaped bottom surface of the top plate is connectable into an opening defined by the U-shaped top surface of the bottom face piece to connect the bottom face piece and the top plate;

the bottom face piece and top plate sized and configured to receive a mask between them when connected together; and two elastic straps attached to the top plate, a first of the two elastic straps attached to a top half of the top plate, and a second of the two elastic straps attached to a bottom half of the top plate.

2. The face mask apparatus of claim 1 wherein the top plate and the bottom face piece are fabricated from plastic, or rubber.

3. The face mask apparatus of claim 1 wherein the ring shaped body further defining a flat bottom surface.

4. The face mask apparatus of claim 1 wherein the top plate further defining a flat bottom surface.

5. The face mask apparatus of claim 1 wherein the U-shaped bottom surface of the top plate is fitted into an opening defined by the U-shaped top surface of the bottom face piece to connect the bottom face piece and the top plate.

6. The face mask apparatus of claim 1 further comprising a mask sandwiched between the bottom face piece and top plate by a portion of the mask fitting in the U-shaped top surface of the bottom face with the inner part of the U-shaped bottom surface of the top plate.

7. The face mask apparatus of claim 6 wherein the mask has an approximately circular cross sectional area.

8. The face mask apparatus of claim 6 wherein the mask is a disposable dust mask.

9. The face mask apparatus of claim 6 wherein the mask has a portion of a strap directly attached to it, the portion of the strap being cut so as to not form a full loop.

10. The face mask apparatus of claim 1 wherein the first of the two elastic straps attached to the top half of the top plate by connecting to a first and second of four loops molded into the top plate.

11. The face mask apparatus of claim 1 wherein the second of the two elastic straps attached to the bottom half of the top plate by connecting to a third and fourth of four loops molded into the top plate.

12. A method of assembling the face mask apparatus of claim 1 comprising the steps of:

cutting a strap off of a mask;

placing the face piece flat on a surface;

sliding the mask inside the U-shaped wall;

snapping the top plate over the top of the mask and into the U-shaped wall of the face piece such that the portion of the mask fits in the U-shaped top surface of the bottom face with the inner part of the U-shaped bottom surface of the top plate fitted into the U-shaped opening of the face piece.

13. A face mask apparatus comprising:

a bottom face piece having a ring shaped body, the ring shaped body defining a U-shaped top surface;

a top plate having a ring shape, the top plate defining a U-shaped bottom surface, the top plate having an outer diameter slightly larger than an outer diameter of the bottom face piece such that an inner part of the U-shaped bottom surface of the top plate is connectable into an opening defined by the U-shaped top surface of the bottom face piece to connect the bottom face piece and the top plate;

the bottom face piece and top plate sized and configured to receive a mask between them when connected together;

an elastic strap attached to a middle section of the top plate;

wherein, the top plate and the elastic strap form a consolidated piece;

wherein the mask has a portion of a strap directly attached to it, the portion of the strap being cut so as to not form a full loop.

* * * * *